US007806673B2

(12) United States Patent
Muscarella et al.

(10) Patent No.: US 7,806,673 B2
(45) Date of Patent: Oct. 5, 2010

(54) GEAR PUMP

(75) Inventors: Stephen B. Muscarella, Henrietta, NY (US); Philip T. Pascoe, Rochester, NY (US)

(73) Assignee: Pulsafeeder, Inc., Rochester, NY (US)

( * ) Notice: Subject to any disclaimer, the term of this patent is extended or adjusted under 35 U.S.C. 154(b) by 0 days.

(21) Appl. No.: 11/194,902

(22) Filed: Aug. 1, 2005

(65) Prior Publication Data

US 2006/0024188 A1 Feb. 2, 2006

Related U.S. Application Data

(60) Provisional application No. 60/592,988, filed on Jul. 30, 2004.

(51) Int. Cl.
*F01C 1/18* (2006.01)

(52) U.S. Cl. ..... 418/206.8

(58) Field of Classification Search ..... None
See application file for complete search history.

(56) References Cited

U.S. PATENT DOCUMENTS

| | | | | | |
|---|---|---|---|---|---|
| 2,528,343 | A | * | 10/1950 | Davis | 285/18 |
| 3,881,849 | A | * | 5/1975 | Commarmot et al. | 418/182 |
| 4,394,562 | A | * | 7/1983 | Epstein et al. | 392/489 |
| 4,583,924 | A | | 4/1986 | Zenglein et al. | |
| 5,012,837 | A | * | 5/1991 | Zepp | 137/99 |
| 5,540,569 | A | * | 7/1996 | Altham et al. | 417/420 |
| 5,704,767 | A | * | 1/1998 | Johnson | 417/43 |
| 5,725,362 | A | * | 3/1998 | Zepp et al. | 417/366 |
| 5,727,933 | A | * | 3/1998 | Laskaris et al. | 418/2 |
| 6,010,321 | A | * | 1/2000 | Forsythe et al. | 418/102 |
| 6,033,193 | A | | 3/2000 | Pieters et al. | |
| 6,053,718 | A | | 4/2000 | Schmidt et al. | |
| 6,158,983 | A | * | 12/2000 | Harpole et al. | 417/410.4 |
| 6,761,546 | B2 | | 7/2004 | Schlipf et al. | |
| 2004/0105768 | A1 | | 6/2004 | Cameron et al. | |

* cited by examiner

*Primary Examiner*—Thomas Denion
*Assistant Examiner*—Douglas J. Duff
(74) *Attorney, Agent, or Firm*—Hodgson Russ LLP

(57) ABSTRACT

A nonmetallic pump with a gear pump assembly having an adapter spool mounted to an electric motor. The pump assembly is designed to reduce manufacturing costs and to provide access for many service and maintenance tasks to be performed without breaking any of the pipe connections. The pump assembly also includes a splined shaft system and a lubricating fluid circulation system with spiral grooves located inside a pair of bearings disposed on opposite sides of the gear flights. The assembly also includes a replaceable precision liner that surrounds the gear flights to maintain a tight tolerance for optimal performance of the pump. Also, an O-ring disposed inside the front cover of the assembly provides for operation of the pump over a wide temperature variation with relatively loose manufacturing tolerances.

15 Claims, 7 Drawing Sheets

GEAR PUMP

CROSS-REFERENCE TO RELATED APPLICATION

This application claims priority to U.S. Provisional Patent Application No. 60/592,988 filed Jul. 30, 2004, and entitled "Gear Pump," which is incorporated herein by reference.

FIELD OF THE INVENTION

The present invention pertains to a gear pump.

BACKGROUND OF THE INVENTION

Positive displacement gear pumps can be used for low rate metering pump applications. Depending on the substances to be conveyed, chemical resistance may be a required characteristic of the materials of construction for the pump. In order to handle corrosive materials, the pumps are typically constructed from corrosion resistant materials such as 316 stainless steel. There is a need for a non-metallic pump that is easier and less expensive to manufacture and that is chemically resistant.

SUMMARY OF THE INVENTION

The present invention meets the above-described need by providing a non-metallic pump with a central housing having a suction side, a discharge side, a top flange and a bottom flange. A drive gear assembly is disposed in the central housing. The drive gear assembly comprises a drive shaft having a plurality of first gear flights extending therefrom. An idler gear assembly is disposed in the central housing in operative relation to the drive gear assembly. The idler gear assembly comprises an idler shaft having a plurality of second gear flights. A first bearing has a pair of openings defined therein. The openings are capable of receiving the drive shaft and idler shaft. A second bearing has a pair of openings defined therein. The openings are capable of receiving the drive shaft and the idler shaft. A gear insert is disposed between the first and second bearings and is sized to fit over the plurality of first and second gear flights. The gear insert has an inner wall disposed in spaced apart relation to the gear flights. A cover is attached to the top flange of the central housing and encloses the drive and idler gear assemblies. An adapter spool has a central opening for receiving a containment can. The adapter spool has a top flange and a bottom flange. The top flange is capable of mating with the bottom flange of the central housing. A drive magnet assembly is disposed in the adaptor spool. A driven magnet assembly is disposed in the containment can in operative relation to the drive magnet assembly. An electric motor is coupled to the drive magnet assembly.

BRIEF DESCRIPTION OF THE DRAWINGS

The invention is illustrated in the drawings in which like reference characters designate the same or similar parts throughout the figures of which.

DETAILED DESCRIPTION

Figure 1:
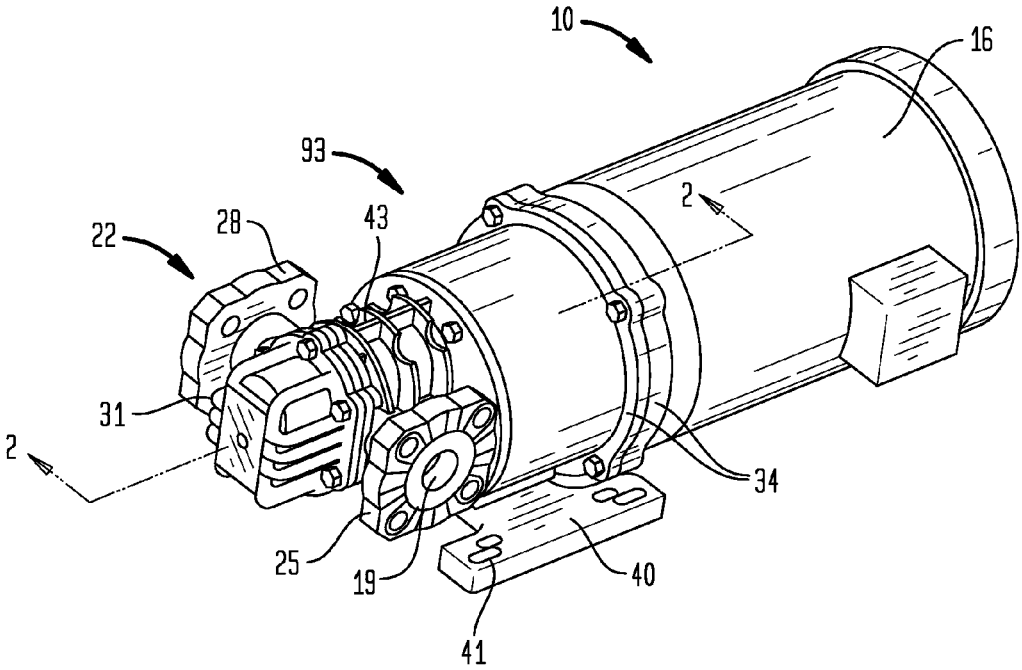
FIG. 1 is a perspective view of a gear pump of the present invention.

Referring to FIG. 1, a gear pump assembly 10 includes an adaptor spool 93 mounted to an electric motor 16. An inlet port 19 and an outlet port 22 include universal flanges 25, 28 with alignment features as described in greater detail herein. The assembly 10 is also provided with a front cover 31 that provides access to the internal parts. Most maintenance and service tasks can be performed by opening the front cover 31 without the need for breaking any of the pipe connections. The gear pump assembly 10 is constructed of non-metallic parts as described in greater detail below.

The adaptor spool 93 has a motor adaptor plate 34 with multiple patterns for use with NEMA or IEC type motor enclosures. The center housing 43 can be rotated in forty-five degree increments to provide a vertical orientation for the input and output ports 19 and 22. The base plate 40 has multiple slotted patterns 41 that match standard motor mounting patterns for retrofitting the assembly 10 to match the footprint of existing installed pumps.

Figure 2:
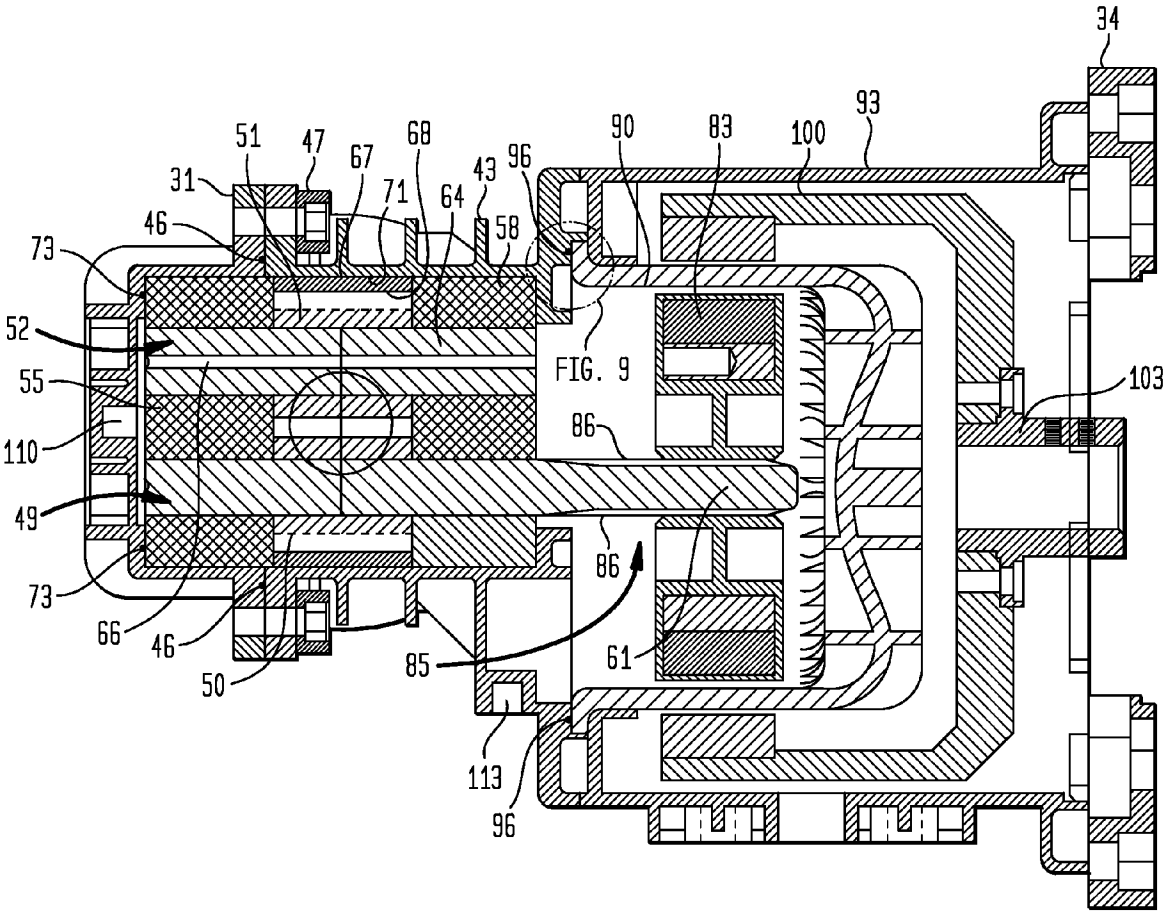
FIG. 2 is a cross-sectional view taken along lines 2-2 of FIG. 1.
Figure 3:
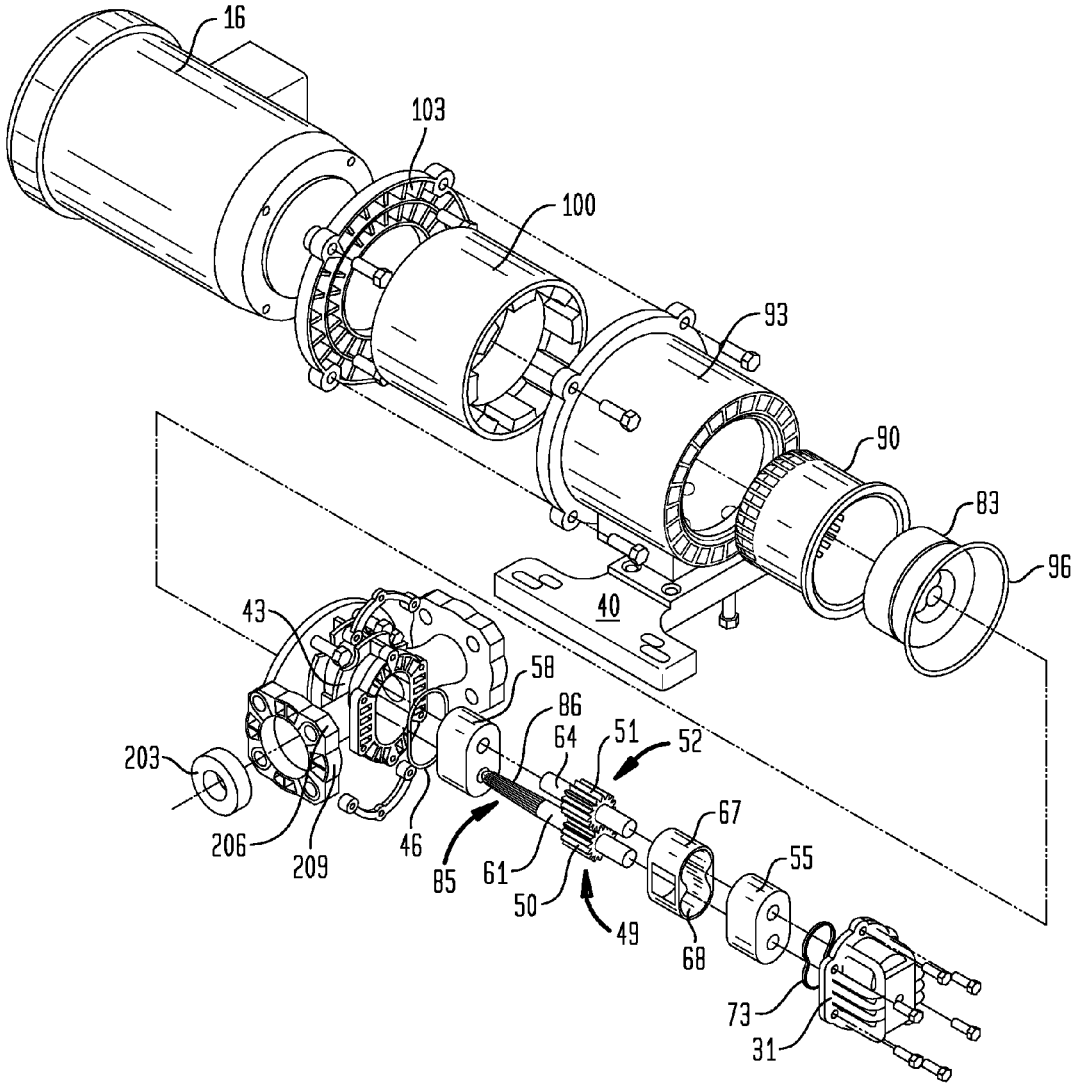
FIG. 3 is an exploded view of the gear pump assembly of the present invention.

Turning to FIGS. 2 and 3, the front cover 31 is bolted to the center housing 43 and is sealed with a first O-ring 46. For ease of installation, the center housing 43 is provided with nut retaining plates 47 that automatically hold the nuts in place to provide for installation of the mounting bolts with a single socket or wrench. The center housing 43 and the cover 31 form a pump chamber that contains the drive gear assembly 49 and the idler gear assembly 52. The gear assemblies 49, 52 may be constructed of Ethylene/Tetrafluoroethylene ("ETFE") copolymer which is an injection molded fluoropolymer having chemical resistance properties suitable for a wide variety of applications. Alternate non-metallic materials are also suitable as will be evident to those of ordinary skill in the art. The gear assemblies 49, 52 have gear teeth 50, 51 that are integrally molded on their respective shafts 61, 64. Shafts 61, 64 are manufactured from non-metallic and preferably ceramic materials.

A pair of bearings 55, 58 support the drive shaft 61 and the idler shaft 64. The bearings 55, 58 are disposed on opposite sides of the gears 49, 52 and can be mounted facing in either direction. The bearings 55, 58 include wear plates with fluid grooves on the surfaces facing the gear teeth 50, 51 as will be described in further detail herein.

A gear insert or liner 67 is disposed around the teeth 50, 51 of the respective gear assemblies 49, 52. The liner 67 is a precision manufactured part having an inner wall 68 that is disposed in spaced apart relation to the teeth on the gear assemblies 49, 52. The gap between the end of the teeth of the gear assemblies 49, 52 and the inner wall 68 is maintained to a tight tolerance in order to provide optimal performance of the pump assembly 10. The liner 67 provides for control of tolerances and easy replacement. The pump assembly 10 can be maintained and restored to its original performance by replacing the liner 67. The replaceable liner 67 also prevents the gear teeth from damaging the inner wall 71 of the center housing 43 when the bearings are worn out.

A second O-ring 73 is disposed inside the front cover 31 and acts as a spring and takes up any variation in tolerance resulting from variations in the length of the housing 43, cover 31, bearings 55, 58 or the liner 67. The O-ring 73 also compensates for thermal expansion of the parts. By taking up the tolerance, the O-ring 73 reduces the cost of manufacturing the housing 43, cover 31, bearings 55, 58 and the liner 67. Under low pressure, the O-ring 73 exerts a force against the outer bearing causing it to press against the liner. Under high pressure, the hydraulic fluid forces the bearings against the liner. An opening 66 is used in the idler shaft 64 to balance this hydraulic force equally from side to side. Other manufacturer's assemblies typically require highly toleranced metal parts to achieve tolerance control or use narrow temperature operating ranges. The present invention allows for use of non-precision non-metallic parts over a wide temperature range.

The shaft 61 of the drive gear 49 engages with a driven magnet assembly 83. The shaft 61 may be constructed from a ceramic material having chemical resistance suitable for a wide variety of applications. The shaft 61 has a spline system 85 comprising a plurality of splines 86 machined thereon such that the driven magnet assembly 83 can float on the splines 86 without any axial load being transmitted to the shaft 61. The spline system 85 eliminates the need for keys and retaining rings for connecting the shaft to the driven magnet. The spline system 85 also spreads out the load from the driven magnet assembly 83. The driven magnet assembly 83 is disposed inside a containment can 90 located in an adaptor spool 93. The containment can 90 is sealed against the center housing by a third O-ring 96. A drive magnet assembly 100 is disposed 15, outside of the containment can 90 and is driven by the electric motor 16 (FIG. 1) as will be evident to those of ordinary skill in the art. The drive magnet assembly 100 is coupled to the motor 16 by an interchangeable motor hub adaptor 103.

The gear pump assembly 10 may be provided with flush and drain ports 110 and 113, respectively.

Figure 4:
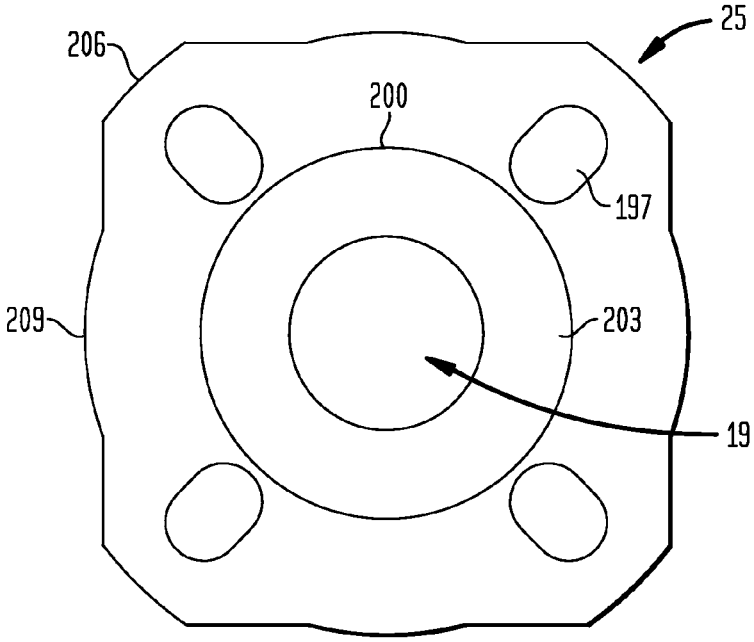
FIG. 4 is a side elevational view of the universal flange of the present invention.

In FIG. 4, universal connection flange 25 is provided to allow the pump to mate to ANSI (American National Standards Institute) and two different DIN (Deutsches Institut fur Normung E.V.) size flanges. This is achieved by incorporating three different patterns for bolt holes 197. To properly align the holes 197 on the universal flange 25 concentrically, a visual indicator is necessary. The visual indicator is provided by utilizing the outside diameter 200 of the raised face sealing surface 203 for one size and a stepped outside diameter with two different diameters 206, 209 for the other two sizes. The raised face sealing surface insert 203 is Polytetrafluoroethylene (Teflon) in the embodiment described, but can be any compliant material. The insert 203 is replaceable in case of damage so the main housing is not sacrificed. The insert 203 can also be reversed to present a fresh side for sealing.

Figure 5:
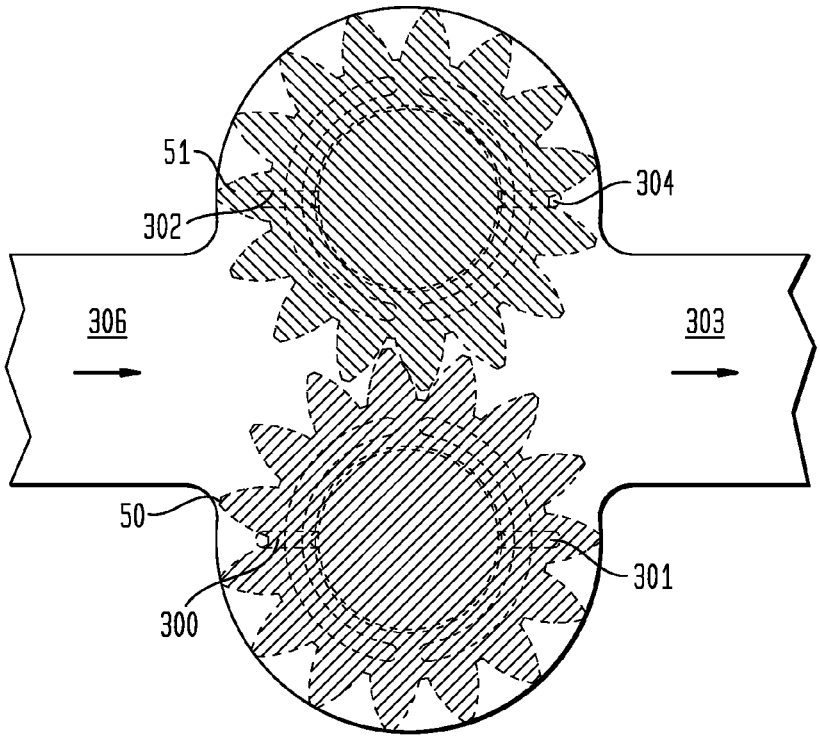
FIG. 5 is a schematic view of the pump chamber of the present invention showing the gear teeth and fluid grooves on the face of the bearing.
Figure 6:
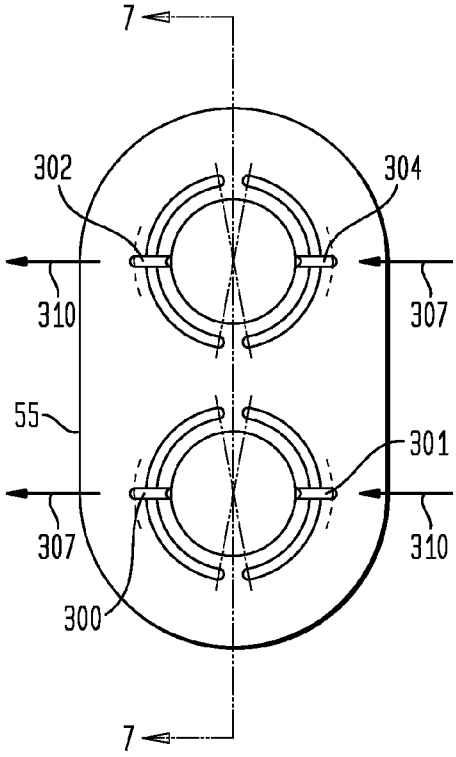
FIG. 6 is a side elevational view of one of the bearings of the present invention.
Figure 7:
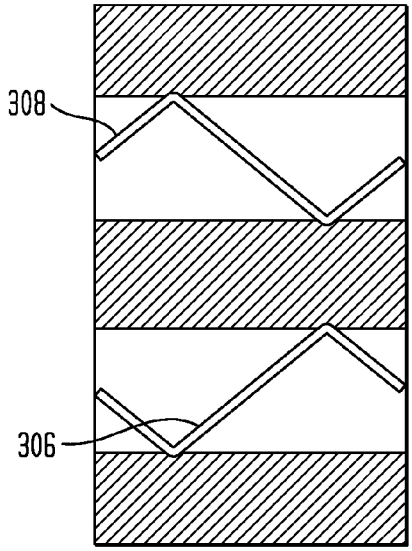
FIG. 7 is a cross-sectional view taken along lines 7-7 of FIG. 6.

Turning to FIGS. 5-7, the pump uses a lubrication system where there are an odd number of teeth 50, 51 on the gear assemblies 49 and 52 which alternately cover and uncover fluid circulation grooves 300, 301, 302, and 304 to recirculate fluid from the discharge side 303 of the pump to the intake 306 of the pump. At the bottom of FIG. 5, the groove 300 on the left hand side of the figure is uncovered providing an open flow path. The groove 304 on the top right hand side of the figure is also open. When the teeth rotate, the grooves 300, 301, 302, and 304 alternate between the open and closed position as described below.

As best shown in FIGS. 6 and 7, the fluid grooves 300 and 302 start on the face of the bearing 55 and follow a spiral pathway 306, 308 (grooves 301 and 304 have identical spiral pathways that are not shown due to the direction of the orientation of the cross-section) to the opposite side of the bearing where the pathway 306 ends on the same side of the bearing. Accordingly, each bearing 55 has a fluid groove that begins at the front and a fluid groove that begins at the rear. Because the orientation of the teeth alternately exposes the grooves 300, 301, 302, 304 to the pumped fluid stream, there is never a time when two grooves are exposed on the same gear. Due to the meshing of the gear pair, as one groove is exposed on the discharge side of a gear, an alternate groove is exposed on the suction side of the second gear. As shown in FIG. 6, the fluid pathway indicated by arrows 307 is as follows: fluid enters the uncovered groove 304 on the discharge side and goes through the spiral pathway to the bottom of the bearing where it then crosses over to the other side. The fluid enters the spiral pathway 306 leading to the uncovered groove 300 on the face at the suction side. Because of the arrangement of the teeth on the gears, the pathway alternates from pathway 307 to a second pathway indicated by arrows 310 in FIG. 6.

Figure 8:
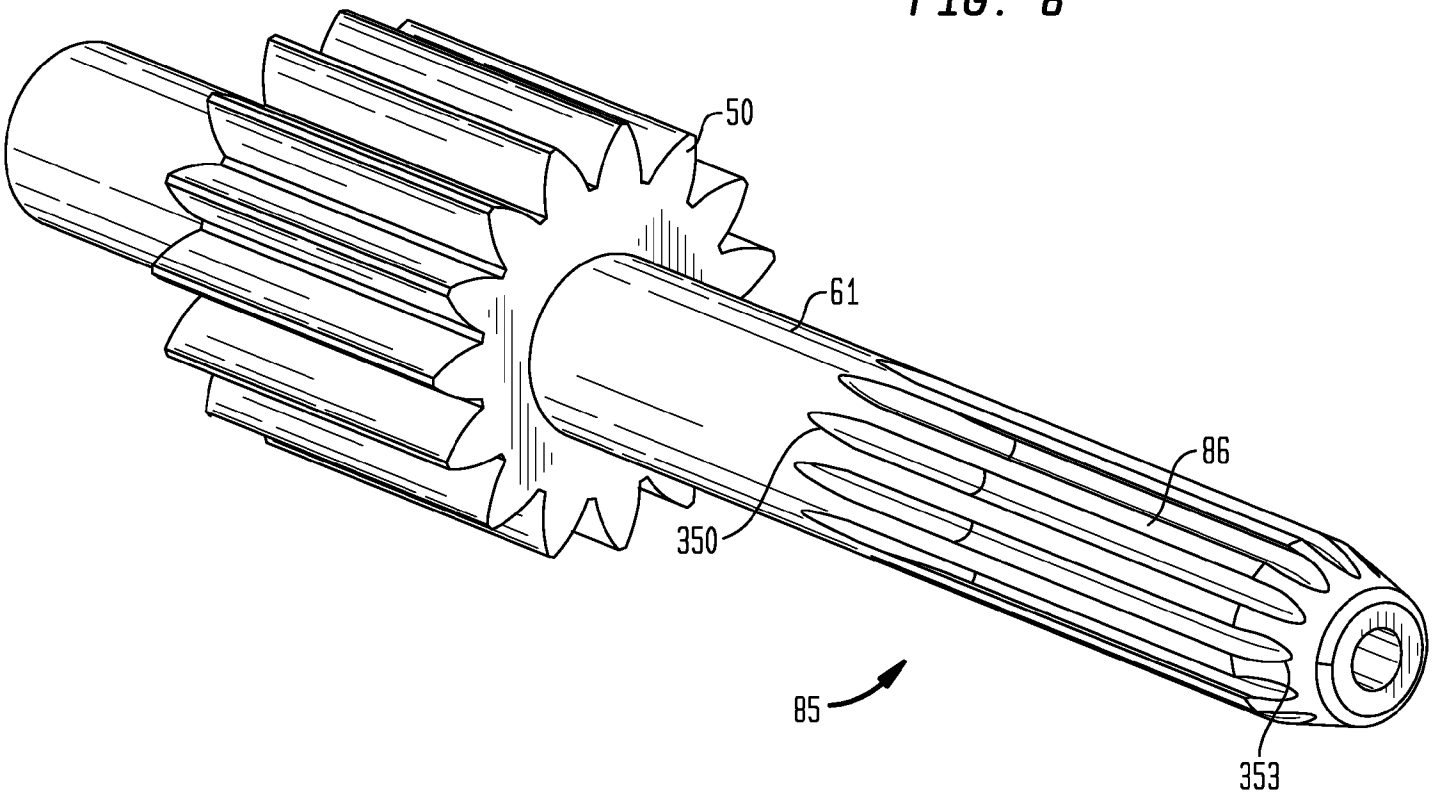
FIG. 8 is a perspective view of the drive shaft.

Turning to FIG. 8, drive shaft 61 with teeth 50 is shown in greater detail. The spline system 85 on drive shaft 61 is manufactured such that the ends of the splines 86 form a smooth transition with the body of the shaft 61. A first feathered section 350 provides a transition from the body of the shaft 61 to the spline 86. At a position located distal to the first feathered section 350, a second feathered section 353 is provided. The smooth transition between the spline system 85 and the shaft 61 eliminates any sharp transitions that could create stress points on the shaft 61.

Figure 9:
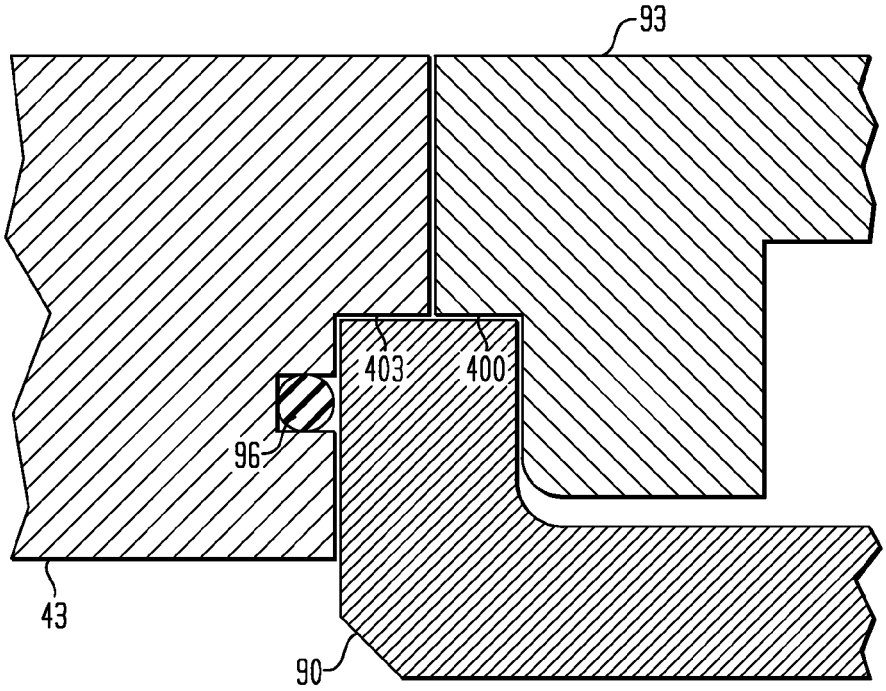
FIG. 9 is a partial enlarged view taken from FIG. 2.

In FIG. 9, the locating feature of the containment can 90 is shown in greater detail. The containment can 90 fits into a recessed portion 400 in the adapter spool 93 such that the containment can 90 is disposed above the top of the adapter spool. The top of the containment can 90 mates with a recessed portion 403 in the center housing 43. Accordingly, the parts locate themselves during assembly such that once the containment can 90 is seated properly, the center housing 43 slides into the correct position and there is a positive indication of proper alignment due to the engagement with the top of the containment can 90.

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A gear pump, comprising:

a central housing having a suction side, a discharge side, a top flange and a bottom flange;

a drive gear assembly disposed in the central housing, the drive gear assembly comprising a drive shaft having a plurality of first gear flights extending therefrom;

an idler gear assembly disposed in the central housing in operative relation to the drive gear assembly, the idler gear assembly comprising an idler shaft having a plurality of second gear flights;

a first bearing having a pair of openings defined therein, the openings capable of receiving the drive shaft and idler shaft;

a second bearing having a pair of openings defined therein, the openings capable of receiving the drive shaft and idler shaft;

a gear insert disposed between the first and second bearings and sized to fit over the plurality of first and second gear flights, the gear insert having an inner wall disposed in spaced apart relation to the gear flights;

a cover attached to the top flange of the central housing and enclosing the drive and idler gear assemblies;

an adapter spool having a central opening for receiving a containment can, the adapter spool having a top flange and a bottom flange, the top flange capable of mating with the bottom flange of the central housing;

a drive magnet assembly disposed in the adaptor spool;

a driven magnet assembly disposed in the containment can in operative relation to the drive magnet assembly; and, an electric motor coupled to the drive magnet assembly;

wherein the bearing has a fluid circulation groove with an inlet on a side facing at least one of the first and second bearings;

wherein each opening in the bearing has a first inlet on a first side and a second inlet on a second side disposed opposite the first side, wherein the drive shaft has an odd number of flights such that one of the first and second inlets is covered when the other of the first and second inlets is uncovered.

2. A gear pump, comprising:

a central housing having a suction side, a discharge side, a top flange and a bottom flange;

a drive gear assembly disposed in the central housing, the drive gear assembly comprising a drive shaft having a plurality of first gear flights extending therefrom;

an idler gear assembly disposed in the central housing in operative relation to the drive gear assembly, the idler gear assembly comprising an idler shaft having a plurality of second gear flights;

a first bearing having a pair of openings defined therein, the openings capable of receiving the drive shaft and idler shaft;

a second bearing having a pair of openings defined therein, the openings capable of receiving the drive shaft and idler shaft;

a gear insert disposed between the first and second bearings and sized to fit over the plurality of first and second gear flights, the gear insert having an inner wall disposed in spaced apart relation to the gear flights;

a cover attached to the top flange of the central housing and enclosing the drive and idler gear assemblies;

an adapter spool having a central opening for receiving a containment can, the adapter spool having a top flange and a bottom flange, the top flange capable of mating with the bottom flange of the central housing;

a drive magnet assembly disposed in the adaptor spool;

a driven magnet assembly disposed in the containment can in operative relation to the drive magnet assembly; and, an electric motor coupled to the drive magnet assembly;

wherein the bearing has a fluid circulation groove with an inlet on a side facing at least one of the first and second bearings;

wherein each opening in the bearing has a first inlet on a first side and a second inlet on a second side disposed opposite the first side wherein the idler shaft has an odd number of flights such that one of the first and second inlets is covered when the other of the first and second inlets is uncovered.

3. A gear pump, comprising:

a central housing having a suction side, a discharge side, a top flange and a bottom flange;

a drive gear assembly disposed in the central housing, the drive gear assembly comprising a drive shaft having a plurality of first gear flights extending therefrom;

an idler gear assembly disposed in the central housing in operative relation to the drive gear assembly, the idler gear assembly comprising an idler shaft having a plurality of second gear flights;

a first bearing having a pair of openings defined therein, the openings capable of receiving the drive shaft and idler shaft;

a second bearing having a pair of openings defined therein, the openings capable of receiving the drive shaft and idler shaft;

a gear insert disposed between the first and second bearings and sized to fit over the plurality of first and second gear flights, the gear insert having an inner wall disposed in spaced apart relation to the gear flights;

a cover attached to the top flange of the central housing and enclosing the drive and idler gear assemblies;

an adapter spool having a central opening for receiving a containment can, the adapter spool having a top flange and a bottom flange, the top flange capable of mating with the bottom flange of the central housing;

a drive magnet assembly disposed in the adaptor spool;

a driven magnet assembly disposed in the containment can in operative relation to the drive magnet assembly; and, an electric motor coupled to the drive magnet assembly;

wherein the bearing has a fluid circulation groove with an inlet on a side facing at least one of the first and second bearings;

wherein each opening in the bearing has a first inlet on a first side and a second inlet on a second side disposed opposite the first side, wherein as the first inlet is exposed on a suction side of the drive gear the second inlet is exposed on a discharge side of the idler gear.

4. A gear pump, comprising:

a central housing having a suction side, a discharge side, a top flange and a bottom flange;

a drive gear assembly disposed in the central housing, the drive gear assembly comprising a drive shaft having a plurality of first gear flights extending therefrom;

an idler gear assembly disposed in the central housing in operative relation to the drive gear assembly, the idler gear assembly comprising an idler shaft having a plurality of second gear flights;

a first bearing having inner walls defining a pair of openings, the openings capable of receiving the drive shaft and idler shaft, each opening in the first bearing having a first fluid circulation inlet on a first side and having a second fluid circulation inlet on a second side disposed opposite from the first side, the first fluid circulation inlet leading to a fluid circulation groove defined in the inner walls of the first bearing and extending from one end of the first bearing to the opposite end;

a second bearing having inner walls defining a pair of openings, the openings capable of receiving the drive shaft and idler shaft, each opening in the second bearing having a first fluid circulation inlet on a first side and having a second fluid circulation inlet on a second side disposed opposite from the first side, the first fluid circulation inlet leading to a fluid circulation groove defined in the inner walls of the second bearing and extending from one end of the second bearing to the opposite end;

a gear insert disposed between the first and second bearings and sized to fit over the plurality of first and second gear flights, the gear insert having an inner wall disposed in spaced apart relation to the gear flights;

a cover attached to the top flange of the central housing and enclosing the drive and idler gear assemblies;

an adapter spool having a central opening for receiving a containment can, the adapter spool having a top flange and a bottom flange, the top flange capable of mating with the bottom flange of the central housing;

a drive magnet assembly disposed in the adaptor spool;

a driven magnet assembly disposed in the containment can in operative relation to the drive magnet assembly;

an electric motor coupled to the drive magnet assembly; and, wherein the first and second gear flights are disposed such that when the first inlet is exposed on a suction side of the drive gear the second inlet is exposed on a discharge side of the idler gear.

5. The gear pump of claim 4, wherein the first and second inlets are approximately 180 degrees apart.

6. The gear pump of claim 4, wherein the drive shaft and idler shaft have an odd number of flights.

7. The gear pump of claim 4, wherein the drive shaft further comprises a plurality of splines formed therein.

8. The gear pump of claim 4, wherein the drive shaft is ceramic.

9. The gear pump of claim 4, further comprising:

an O-ring disposed between the second bearing and the cover.

10. The gear pump of claim 4, further comprising:

universal flanges on the suction and discharge sides.

11. The gear pump of claim 4, wherein the containment can fits into a recessed portion in the adapter spool such that an end of the containment can extends beyond an end of the adapter spool.

12. The gear pump of claim 11, wherein the central housing has a recessed portion that receives the end of the containment can.

13. A gear pump, comprising:

a central housing having a suction side, a discharge side, a top flange and a bottom flange;

a drive gear assembly disposed in the central housing, the drive gear assembly comprising a drive shaft having a plurality of first gear flights extending therefrom, the drive shaft having a plurality of splines formed therein;

an idler gear assembly disposed in the central housing in operative relation to the drive gear assembly, the idler gear assembly comprising an idler shaft having a plurality of second gear flights;

a first bearing having a pair of openings defined therein, the openings capable of receiving the drive shaft and idler shaft;

a second bearing having a pair of openings defined therein, the openings capable of receiving the drive shaft and idler shaft;

a gear insert disposed between the first and second bearings and sized to fit over the plurality of first and second gear flights, the gear insert having an inner wall disposed in spaced apart relation to the gear flights;

a cover attached to the top flange of the central housing and enclosing the drive and idler gear assemblies;

an O-ring disposed between the second bearing and the cover;

an adapter spool having a central opening for receiving a containment can, the adapter spool having a top flange and a bottom flange, the top flange capable of mating with the bottom flange of the central housing;

a drive magnet assembly disposed in the adaptor spool;

a driven magnet assembly disposed in the containment can in operative relation to the drive magnet assembly; and, an electric motor coupled to the drive magnet assembly, wherein the bearing has a fluid circulation groove with an inlet on a side facing at least one of the first and second bearings;

wherein each opening in the bearing has a first inlet on a first side and a second inlet on a second side disposed opposite the first side;

wherein the drive shaft has an odd number of flights such that one of the first and second inlets is covered when the other of the first and second inlets is uncovered.

14. A gear pump, comprising:

a central housing having a suction side, a discharge side, a top flange and a bottom flange;

a drive gear assembly disposed in the central housing, the drive gear assembly comprising a drive shaft having a plurality of first gear flights extending therefrom, the drive shaft having a plurality of splines formed therein;

an idler gear assembly disposed in the central housing in operative relation to the drive gear assembly, the idler gear assembly comprising an idler shaft having a plurality of second gear flights;

a first bearing having a pair of openings defined therein, the openings capable of receiving the drive shaft and idler shaft;

a second bearing having a pair of openings defined therein, the openings capable of receiving the drive shaft and idler shaft;

a gear insert disposed between the first and second bearings and sized to fit over the plurality of first and second gear flights, the gear insert having an inner wall disposed in spaced apart relation to the gear flights;

a cover attached to the top flange of the central housing and enclosing the drive and idler gear assemblies;

an O-ring disposed between the second bearing and the cover;

an adapter spool having a central opening for receiving a containment can, the adapter spool having a top flange and a bottom flange, the top flange capable of mating with the bottom flange of the central housing;

a drive magnet assembly disposed in the adaptor spool;

a driven magnet assembly disposed in the containment can in operative relation to the drive magnet assembly; and, an electric motor coupled to the drive magnet assembly;

wherein the bearing has a fluid circulation groove with an inlet on a side facing at least one of the first and second bearings;

wherein each opening in the bearing has a first inlet on a first side and a second inlet on a second side disposed opposite the first side, wherein the idler shaft has an odd number of flights such that one of the first and second inlets is covered when the other of the first and second inlets is uncovered.

15. A gear pump, comprising:

a central housing having a suction side, a discharge side, a top flange and a bottom flange;

a drive gear assembly disposed in the central housing, the drive gear assembly comprising a drive shaft having a plurality of first gear flights extending therefrom, the drive shaft having a plurality of splines formed therein;

an idler gear assembly disposed in the central housing in operative relation to the drive gear assembly, the idler gear assembly comprising an idler shaft having a plurality of second gear flights;

a first bearing having a pair of openings defined therein, the openings capable of receiving the drive shaft and idler shaft;

a second bearing having a pair of openings defined therein, the openings capable of receiving the drive shaft and idler shaft;

a gear insert disposed between the first and second bearings and sized to fit over the plurality of first and second gear flights, the gear insert having an inner wall disposed in spaced apart relation to the gear flights;

a cover attached to the top flange of the central housing and enclosing the drive and idler gear assemblies;

an O-ring disposed between the second bearing and the cover;

an adapter spool having a central opening for receiving a containment can, the adapter spool having a top flange and a bottom flange, the top flange capable of mating with the bottom flange of the central housing;

a drive magnet assembly disposed in the adaptor spool;

a driven magnet assembly disposed in the containment can in operative relation to the drive magnet assembly; and, an electric motor coupled to the drive magnet assembly;

wherein the bearing has a fluid circulation groove with an inlet on a side facing at least one of the first and second bearings;

wherein each opening in the bearing has a first inlet on a first side and a second inlet on a second side disposed opposite the first side, wherein as the first inlet is exposed on a suction side of the drive gear the second inlet is exposed on a discharge side of the idler gear.

* * * * *